US010737164B2

(12) United States Patent
Lo

(10) Patent No.: US 10,737,164 B2
(45) Date of Patent: Aug. 11, 2020

(54) BICYCLE TRAINER FASTENING DEVICE

(71) Applicant: GIANT MANUFACTURING CO., LTD., Taichung (TW)

(72) Inventor: Wen-Hai Lo, Taichung (TW)

(73) Assignee: GIANT MANUFACTURING CO., LTD., Taichung (TW)

( * ) Notice: Subject to any disclaimer, the term of this patent is extended or adjusted under 35 U.S.C. 154(b) by 15 days.

(21) Appl. No.: 15/668,276

(22) Filed: Aug. 3, 2017

(65) Prior Publication Data

US 2018/0193713 A1 Jul. 12, 2018

(30) Foreign Application Priority Data

Jan. 10, 2017 (TW) ..... 106100681 A

(51) Int. Cl.

| | |
|---|---|
| ***A63B 69/16*** | (2006.01) |
| ***A63B 21/00*** | (2006.01) |
| ***A63B 21/22*** | (2006.01) |
| ***A63B 69/00*** | (2006.01) |

(52) U.S. Cl.

CPC ..... *A63B 69/16* (2013.01); *A63B 21/00069* (2013.01); *A63B 21/225* (2013.01); *A63B 21/4049* (2015.10); *A63B 21/00* (2013.01); *A63B 69/00* (2013.01); *A63B 2069/165* (2013.01); *A63B 2069/167* (2013.01); *A63B 2069/168* (2013.01)

(58) Field of Classification Search

CPC ... A63B 69/16; A63B 21/225; A63B 21/4049; A63B 21/00069; A63B 2069/165; A63B 2069/168; A63B 2069/167; A63B 69/00; A63B 21/00; A63B 21/4034; A63B 2225/09; A63B 22/0605

See application file for complete search history.

(56) References Cited

U.S. PATENT DOCUMENTS 4,505,473 A * 3/1985 Pro ..... A63B 69/16 482/61
4,789,153 A * 12/1988 Brown ..... A63B 21/0088 482/111
5,026,047 A * 6/1991 Kosecoff ..... A63B 69/16 434/61

(Continued)

*Primary Examiner* — Andrew S Lo
(74) *Attorney, Agent, or Firm* — Muncy, Geissler, Olds & Lowe, P.C.

(57) ABSTRACT

A bicycle trainer fastening device, disposed on a bicycle trainer, includes a hollow tube, a first fastening member and a second fastening member. The hollow tube includes a first assembly portion and a second assembly portion at two opposite ends thereof. The first fastening member is disposed correspondingly to the first assembly portion, and includes a first through opening correspondingly in communication with the hollow tube and having an aperture corresponding to an inserting shaft of a bicycle. The second fastening member is disposed correspondingly to the second assembly portion, and includes a second through opening correspondingly in communication with the hollow tube and an aperture corresponding to the inserting shaft. By selecting the first through opening and the second through opening corresponding to the shaft diameter of the inserting shaft and replacing the first fastening member and the second fastening member, the scope of applicability can be maximized.

5 Claims, 7 Drawing Sheets

(56) References Cited

U.S. PATENT DOCUMENTS

| | | | | |
|---|---|---|---|---|
| 5,480,366 | A * | 1/1996 | Harnden | A63B 69/16 482/57 |
| 6,659,917 | B1 * | 12/2003 | Tacx | A63B 69/16 482/63 |
| 7,530,932 | B2 * | 5/2009 | Lofgren | A63B 22/0002 482/62 |
| 8,006,945 | B2 * | 8/2011 | Chen | A63B 69/16 248/121 |
| 9,999,818 | B2 * | 6/2018 | Hawkins, III | A63B 24/0087 |
| 10,046,222 | B2 * | 8/2018 | Hawkins, III | A63B 24/0087 |
| 2005/0003934 | A1 * | 1/2005 | Wu | A63B 21/0051 482/64 |
| 2009/0253558 | A1 * | 10/2009 | Lofgren | A63B 22/0002 482/51 |
| 2010/0069205 | A1 * | 3/2010 | Lee | A63B 21/0051 482/63 |
| 2011/0287902 | A1 * | 11/2011 | Bingham, Jr. | A63B 21/0088 482/61 |
| 2013/0053223 | A1 | 2/2013 | Shu-Chiung et al. | |
| 2013/0079199 | A1 * | 3/2013 | Hamilton | A63B 21/0088 482/111 |
| 2016/0023082 | A1 * | 1/2016 | Hamilton | A63B 69/16 248/121 |
| 2017/0216655 | A1 * | 8/2017 | Chang | A63B 21/0051 482/64 |

* cited by examiner

BICYCLE TRAINER FASTENING DEVICE

FIELD OF THE INVENTION

The present invention relates to a fastening device, and particularly to a bicycle trainer fastening device.

BACKGROUND OF THE INVENTION

Bicycles, sometimes referred to as bikes or two-wheelers, are a common type of transportation means. With the changing times, bicycles have become recreational and entertainment tools in the modern lifestyle. When riding a bicycle, one may enjoy ad appreciate sceneries along the way while also achieving purposes of exercising and fitness, and so bicycles are popular among the public. However, in harsh weather conditions such as the rain or excessive particulate matters in the air, riding bicycles outdoors may be inappropriate. Therefore, bicycles trainers have been invented for riders to enjoy the fun of bicycle riding without restrictions of time and weather factors.

For example, the U. S. Patent Publication No. 20130053223, "Training Apparatus for a Bicycle", discloses a common bicycle trainer that includes a support frame, a damping device and a chain wheel group. The damping device and the chain wheel group are disposed on the support frame. The chain wheel group is linked to the damping device, and includes a hollow tube. The hollow tube is mounted on the chain wheel group in a forked manner, and is inserted by an axle and fixed. The bicycle may then be ridden.

The hollow tube of the above bicycle training device has only one aperture. However, there are many types of bicycles, including mountain bicycles and on-road bicycles. The axle diameters of the axles these different types of bicycles are different, in a way that the hollow tube having one single aperture may not be appropriately applied to all of these different types of bicycles. Therefore, there is a need for a solution that allows a bicycle training device to adapt to bicycles having different axle diameters to maximize the scope of applicability.

SUMMARY OF THE INVENTION

It is an object of the present invention to solve the issue of a limited scope of applicability of a conventional bicycle training device that cannot be universally applied for bicycles having different axle diameters.

To achieve the above object, the present invention provides a bicycle trainer fastening device, which is disposed on a bicycle. The bicycle trainer includes a support frame, a damping device and a flywheel assembly. The damping device and the flywheel assembly are disposed on the support frame. The flywheel assembly is linked to the damping device, and includes a variable speed transmission gear. A rear fork of the bicycle, coordinating with an inserting shaft, is disposed on the bicycle trainer. The bicycle training device includes a hollow tube, a first fastening member and a second fastening member. The hollow tube penetrates the axle of the variable speed transmission gear and the support frame to position the variable speed transmission gear on the support frame. The hollow tube includes a first assembly portion and a second assembly portion at two opposite ends thereof, respectively. The first fastening member is correspondingly disposed at the first assembly portion, and includes a first through opening correspondingly in communication with the hollow tube. The aperture of the first through opening corresponds to the inserting shaft. The second fastening member is correspondingly disposed at the second assembly portion, and includes a second through opening correspondingly in communication with the hollow tube. The aperture of the second through opening corresponds to the inserting shaft.

In conclusion, the first fastening member and the second fastening member of the present invention are disposed at two opposite ends of the hollow tube in a replaceable manner, respectively. Thus, by selecting the first through opening and the second through opening corresponding to the shaft diameter of the inserting shaft and replacing the first fastening member and the second fastening member, the present invention is suitable for bicycles having different inserting shaft diameters, thereby maximizing the scope of applicability.

DETAILED DESCRIPTION OF THE PREFERRED EMBODIMENTS

Figure 1:
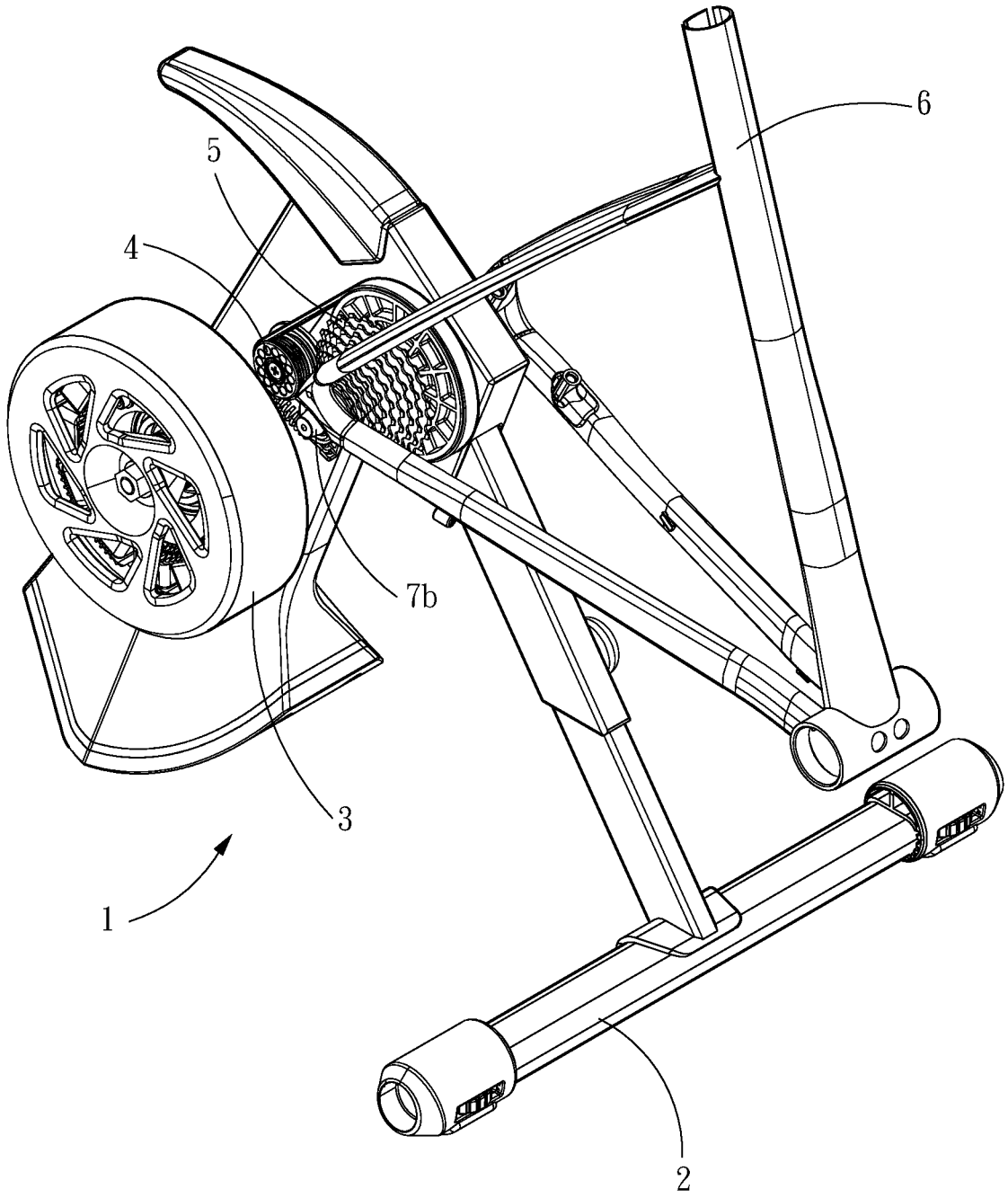
FIG. 1 is a perspective view according to a first embodiment of the present invention.
Figure 2:
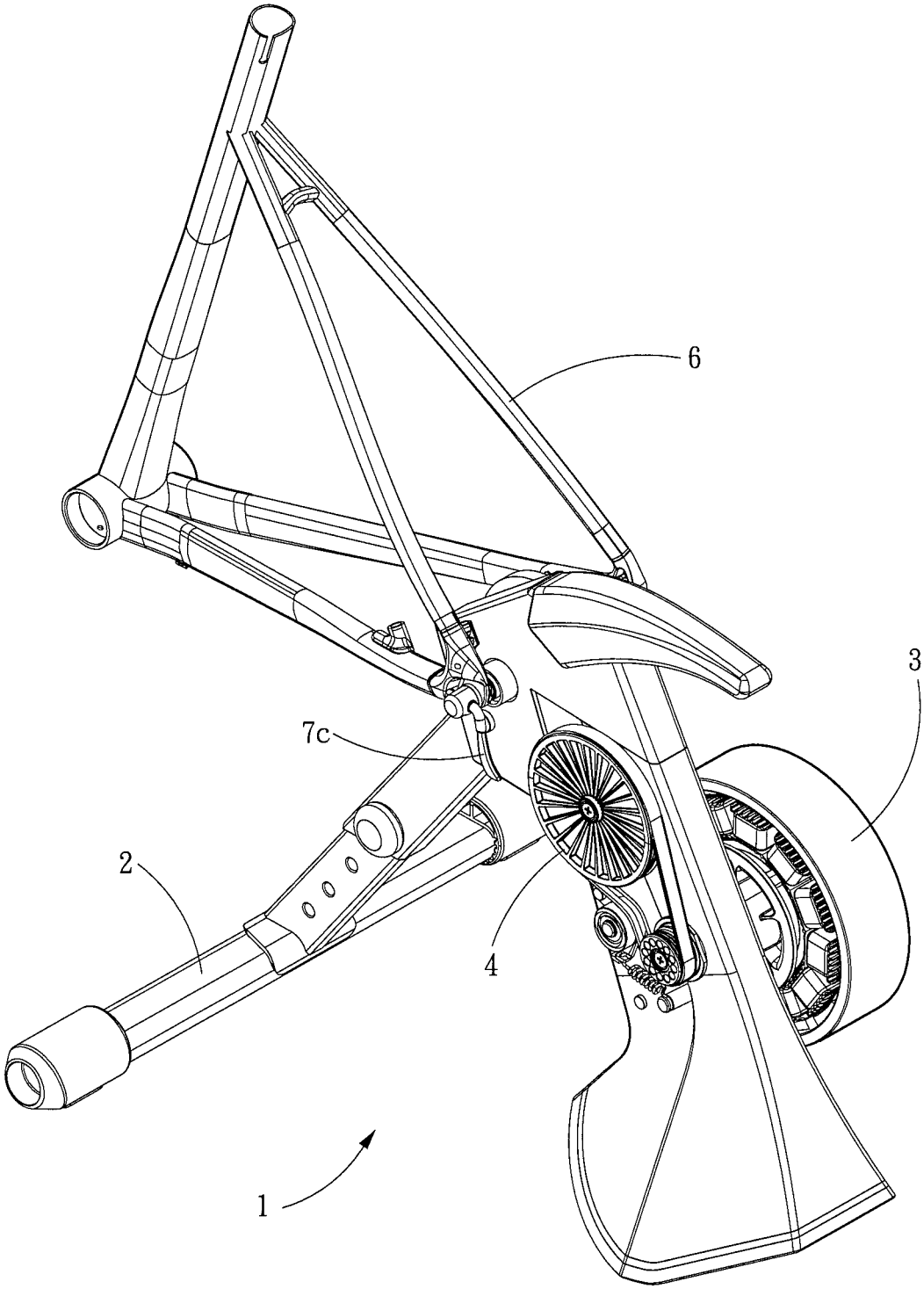
FIG. 2 is a perspective view from another direction according to the first embodiment of the present invention.

Details and technical contents of the present invention are given with the accompanying drawings below.

Referring to FIG. 1 to FIG. 4, the present invention provides a bicycle trainer fastening device, which is disposed on a bicycle trainer 1. The bicycle trainer 1 includes a support frame 2, a damping device 3 and a flywheel assembly 4. The flywheel assembly 4 is linked to the damping device 3. The flywheel assembly 4 includes a variable speed transmission gear 5. A rear fork 6 of the bicycle, coordinating with an inserting shaft 7, is disposed on the bicycle trainer 1. The bicycle training device includes a hollow tube 10, a first fastening member 20 and a second fastening member 30. The hollow tube 10 penetrates the axle of the variable speed transmission gear 5 and the support frame 2 to position the variable speed transmission gear 5 on the support frame 2. The hollow tube 10 includes a first assembly portion 11 and a second assembly portion 12 at two opposite ends thereof, respectively. The first fastening member 20 and the second fastening member 30 are disposed correspondingly to the first assembly portion 11 and the second assembly portion 12, respectively, and include a first through opening 21 and a second through opening 31 correspondingly in communication with the hollow tube 10, respectively. The aperture of the first through opening 21 and the aperture of the second through opening 31 both correspond to the shaft diameter of the inserting shaft 7.

Both of the first fastening member 20 and the second fastening member 30 are disposed at the two opposite ends of the hollow tube 10 in a replaceable manner, respectively. Thus, the first fastening member 20 and the second fastening member 30 may be replaced, in a way that the first through opening 21 of the first fastening member 20 and the second through opening 31 of the second fastening member 30 may correspond to the shaft diameter of the inserting shaft 7 to maximize the scope of applicability. Common shaft lengths of the inserting shaft 7 may be divided into 5 mm and 12 mm.

Figure 3:
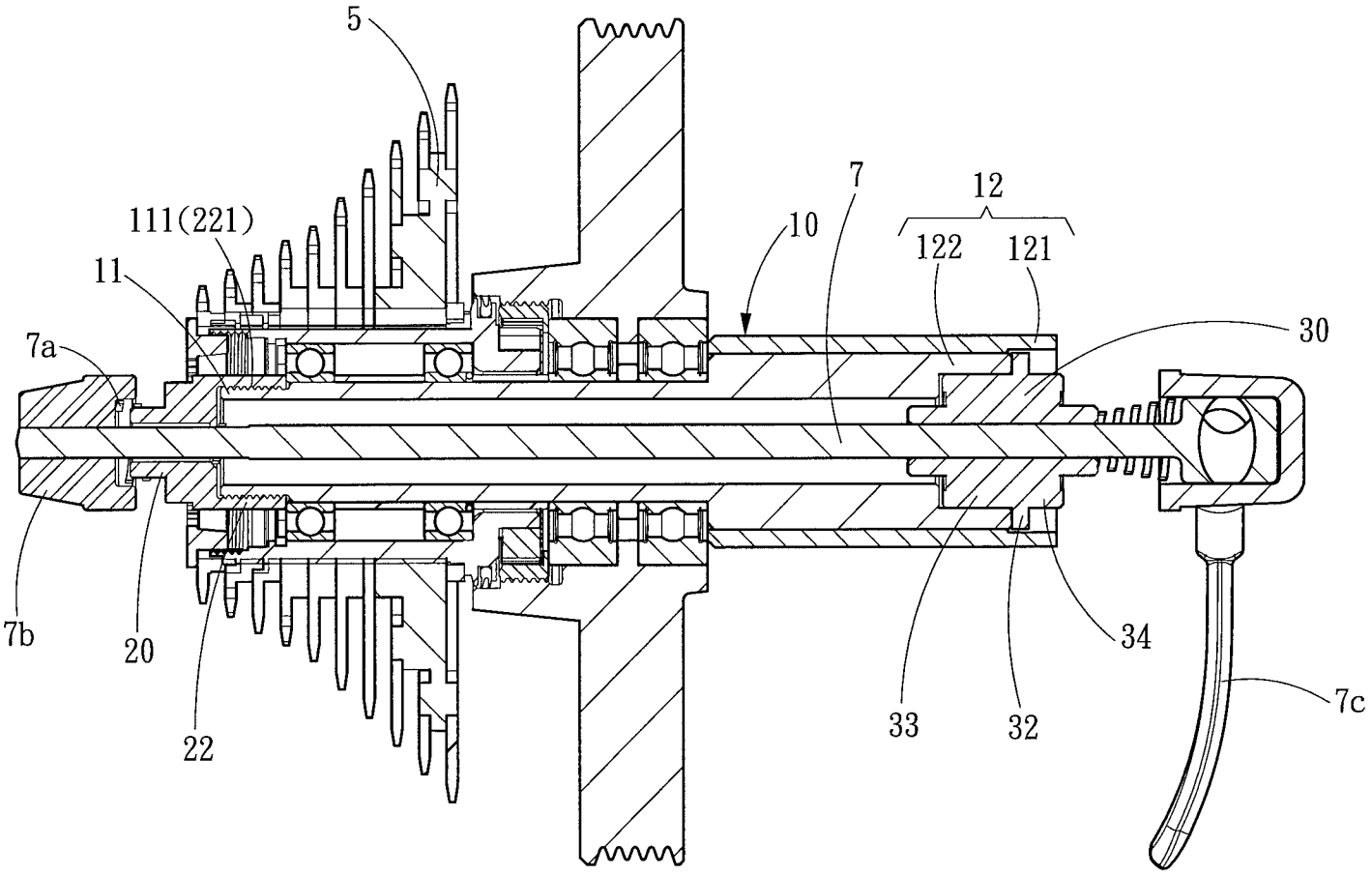
FIG. 3 is a partial section view according to the first embodiment of the present invention.

Referring to FIG. 3, the first fastening member 20 further includes a first abutting portion 22 that mutually fastens with the first assembly portion 11. In the present invention, the first assembly portion 11 includes an external thread 111, and the first abutting portion 22 includes an internal thread 221 that screws and fastens with the external thread 111 to achieve screw fastening. However, the mutual fastening means of the first assembly portion 11 and the first abutting portion 22 is not limited to the above example.

The second fastening member 30 further includes a second abutting portion 32, a first adjusting portion 33 and a second adjusting portion 34. The first adjusting portion 33 and the second adjusting portion 34 are disposed at two opposite ends of the second abutting portion 32, respectively. The length of the first adjusting portion 33 relative to the second abutting portion 32 is longer than the length of the second adjusting portion 34 relative to the second abutting portion 32. The second fastening member 30 has a first position that causes the first adjusting portion 33 to locate in the hollow tube 10, and a second position that causes the second adjusting portion 34 to locate in the hollow tube 10. At the first position, the longer first adjusting portion 33 is located in the hollow tube 10 to adaptively coordinate with the inserting shaft 7 having a shorter length; at the second position, the shorter second adjusting portion 34 is located in the hollow tube 10 to adaptively coordinate with the inserting shaft 7 having a longer length, hence maximizing the convenience and scope of applicability. In FIG. 3, the first position is depicted as an example. In general, when the shaft diameter of the inserting shaft 7 is 5 mm, the length of the inserting shaft 7 may be 130 mm or 135 mm; when the shaft diameter of the inserting shaft 7 is 12 mm, the length of the inserting shaft 7 may be 142 mm or 148 mm.

Therefore, according to the shift diameter and length of the inserting shaft 7 of different bicycles, the first fastening member 20 and the second fastening member 30 may be selectively replaced, so that the bicycle trainer 1 may adapt to applications of various types of bicycles to maximize the convenience and scope of applicability.

In this embodiment, the second assembly portion 12 further includes a fixing section 121 and a support section 122. The fixing section 121 corresponds to the outer diameter of the second abutting portion 32. The support section 122 is located at an end of the fixing section 121 facing the first fastening member 20, and corresponds to the outer diameters of the first adjusting portion 33 and the second adjusting portion 34, so as to accommodate the first adjusting portion 33 and the second adjusting portion 34 to thereby reinforce installation stability.

Figure 4:
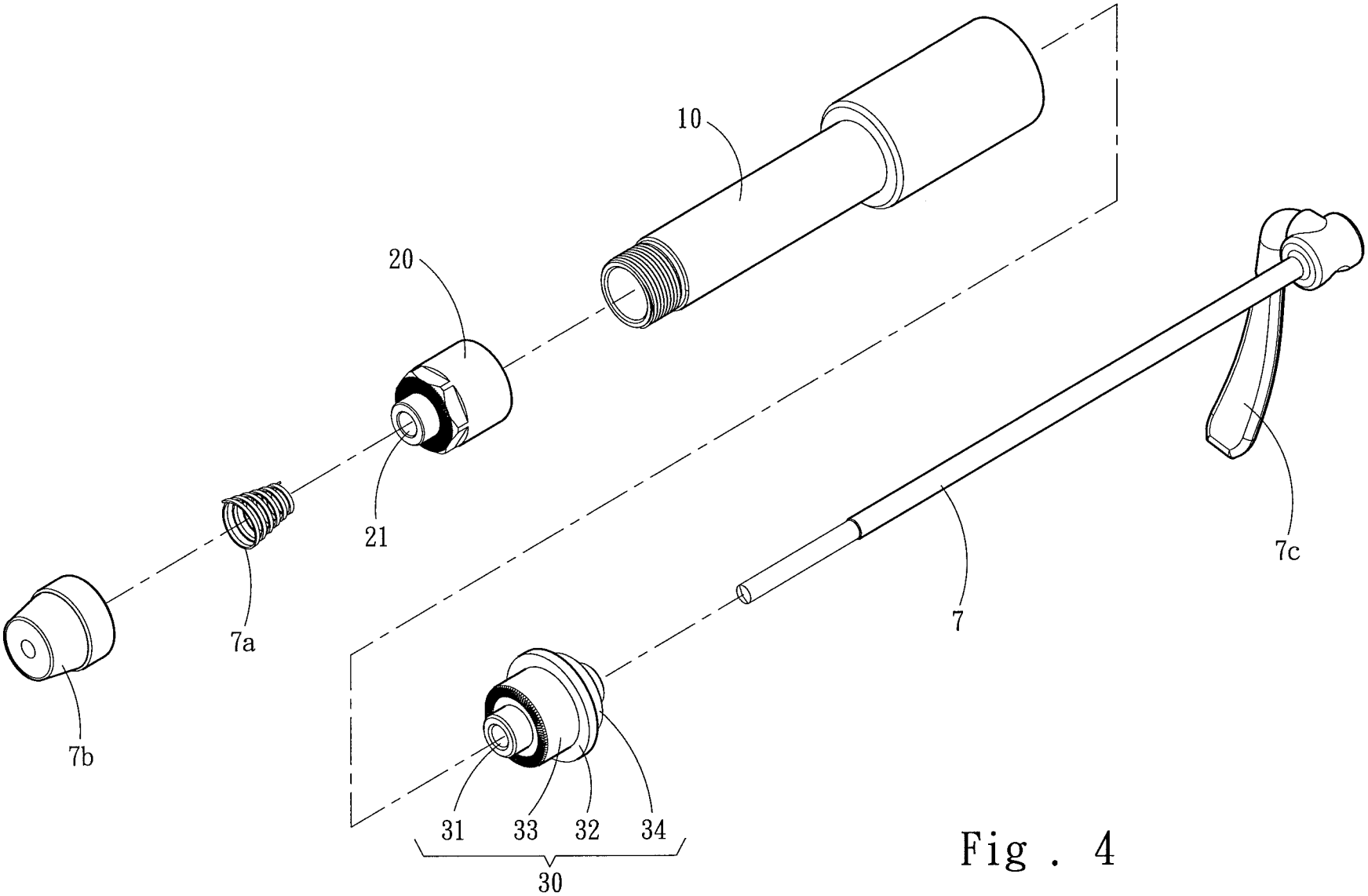
FIG. 4 is a partial exploded view according to the first embodiment of the present invention.

As shown in FIG. 3 and FIG. 4, the inserting shaft 7 is exemplified by a quick release in this embodiment. In addition to the quick release, the inserting shaft 7 further includes a spring 7*a*, a base 7*b* and a handle 7*c*. In general, the shaft diameter of the inserting shaft 7 of a quick release is smaller, and needs to be applied in conjunction with the first through opening 21 and the second through opening 31 having smaller apertures.

Figure 5:
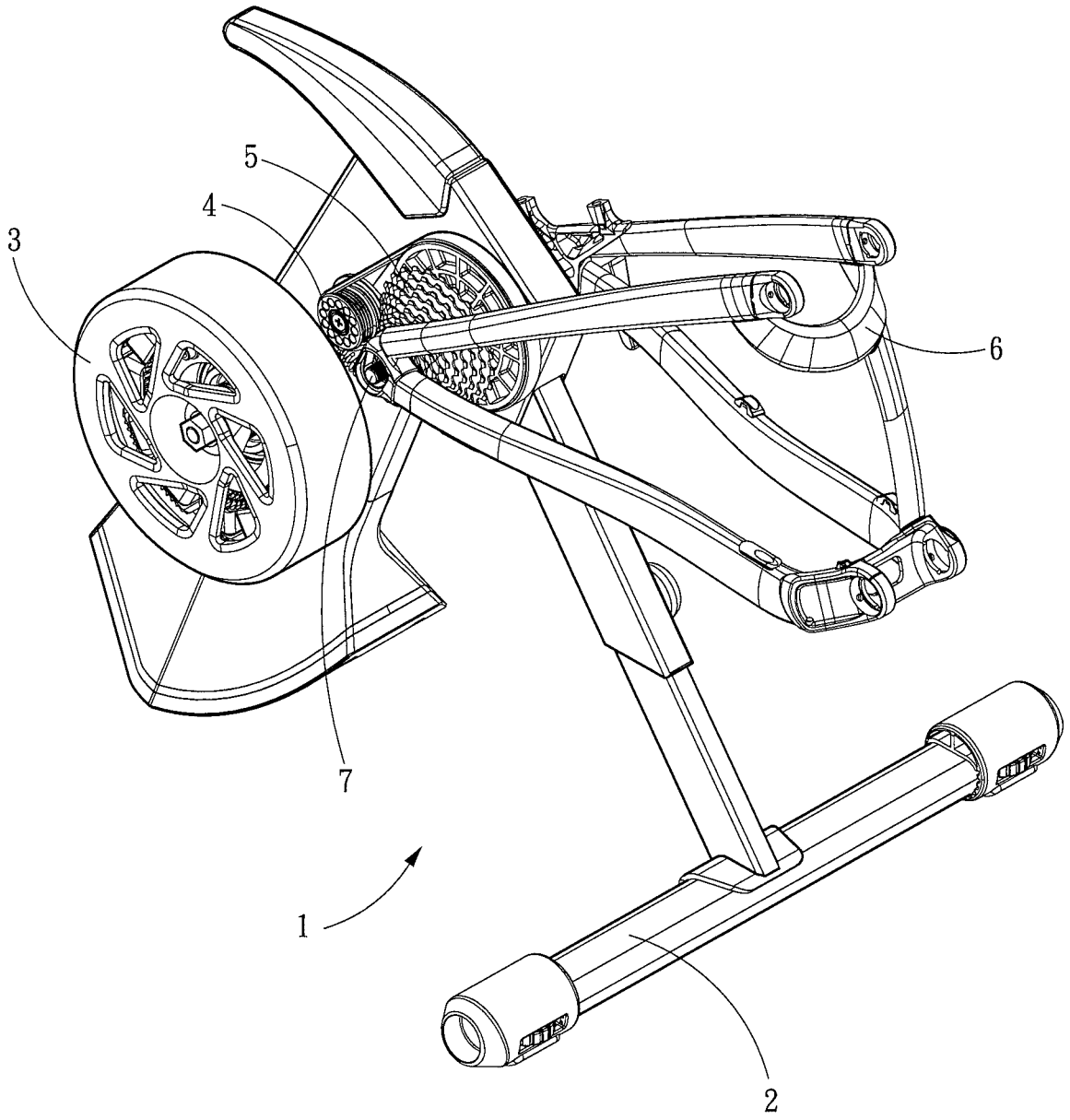
FIG. 5 is a perspective view according to a second embodiment of the present invention.
Figure 6:
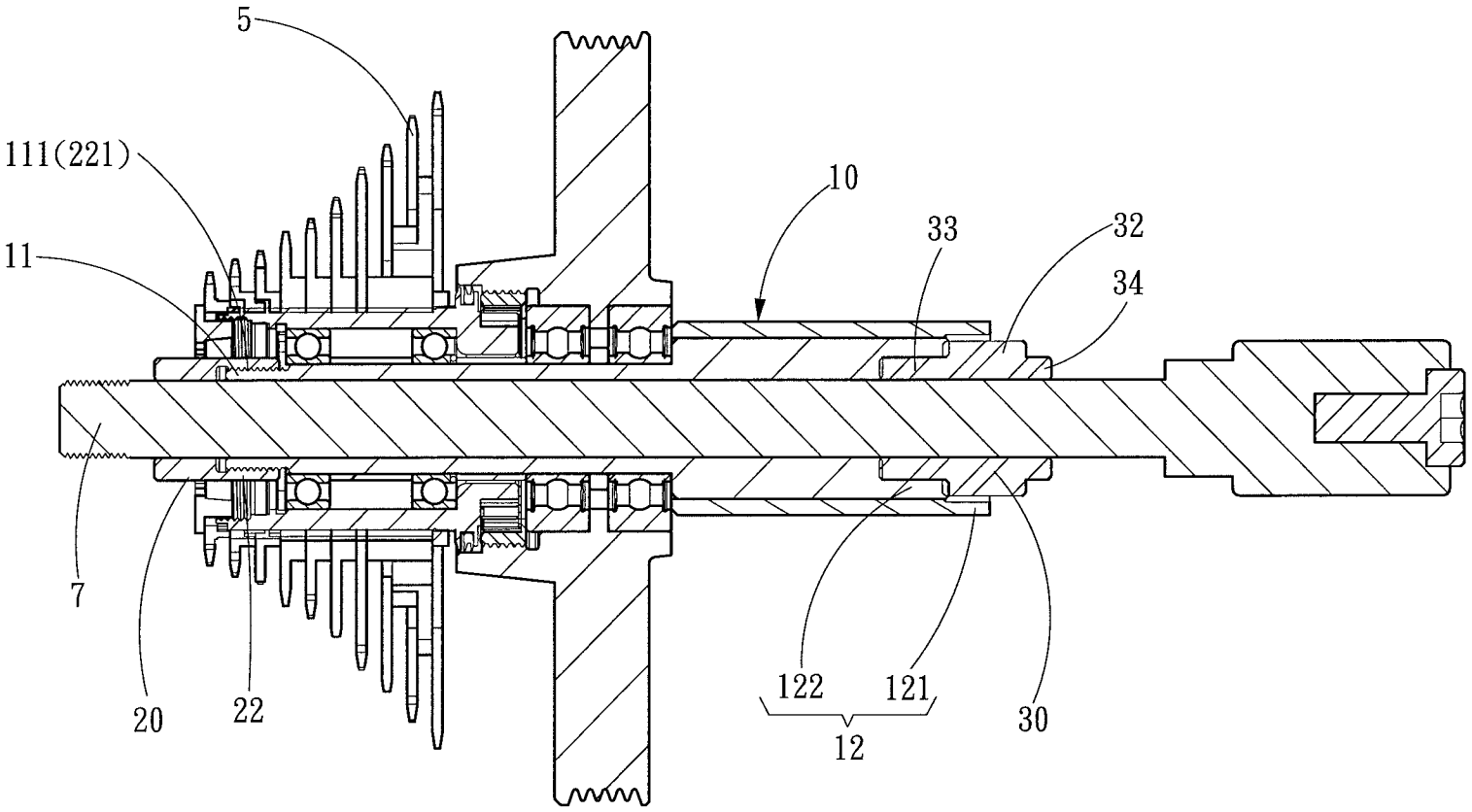
FIG. 6 is a partial section view according to the second embodiment of the present invention.
Figure 7:
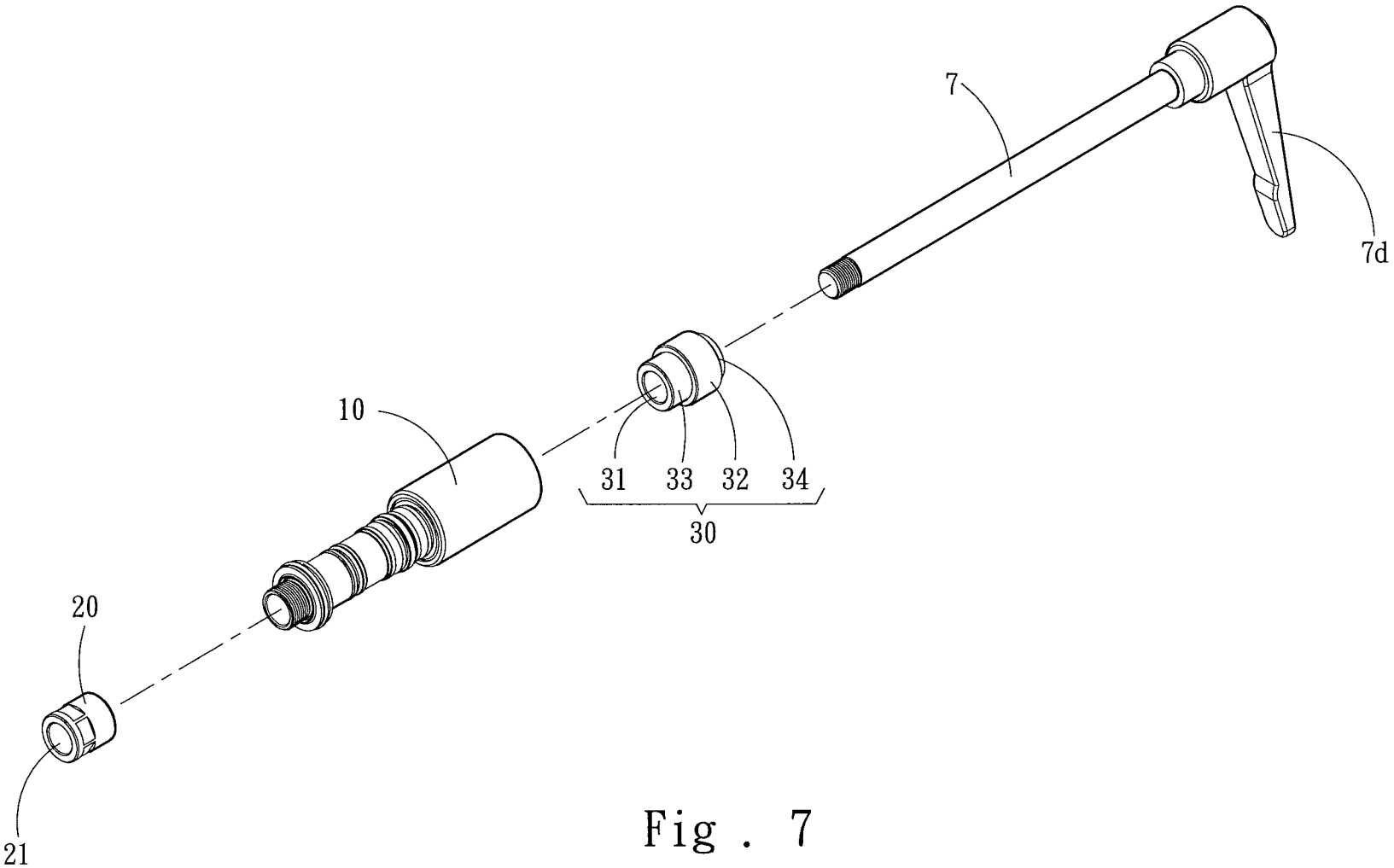
FIG. 7 is a partial exploded view according to the second embodiment of the present invention.

Referring to FIG. 5 to FIG. 7, an example of the inserting shaft 7 is given according to another embodiment of the present invention. The shaft diameter of the inserting shaft 7 in this embodiment is larger than that of a quick release and provides better safety. The inserting shaft 7 includes a rotating handle 7*d* and has a larger shaft diameter, and thus needs to be applied in conjunction with the first through opening 21 and the second through opening 31 having larger apertures.

In conclusion, the present invention provides following features.

1. The first fastening member and the second fastening member may be replaced, such the first through opening of the first fastening member and the second through opening of the second fastening member may correspond to the shaft diameter of the inserting shaft. Thus, the bicycle trainer may adaptively coordinate with various types of bicycles to maximize the convenience and scope of applicability.

2. Through the first adjusting portion and the second adjusting portion having different lengths of the second fastening member, the present invention is suitable for the use of bicycle models having different inserting shaft lengths, and provides an advantage of being extensively applicable to different bicycle models.

3. The support section provided enhances the installation stability.

What is claimed is:

1. A bicycle trainer fastening device, disposed on a bicycle trainer, the bicycle trainer comprising a support frame, a damping device and a flywheel assembly, the damping device and the flywheel assembly disposed on the support frame, the flywheel assembly coupled to the damping device and comprising a variable speed transmission gear, a rear fork of a bicycle configured to be coupled to the bicycle trainer with an inserting shaft of the bicycle trainer, the bicycle trainer fastening device comprising:

a hollow tube, penetrating an axle of the variable speed transmission gear and the support frame to position the variable speed transmission gear on the support frame, the hollow tube comprising a first assembly portion and a second assembly portion at two opposite ends thereof, respectively;

a first fastening member, screwed with the first assembly portion and contacting the inserting shaft, the first fastening member comprising a first through opening having an axis through the first through opening that is aligned with an opening of the hollow tube, an aperture of the first through opening configured to receive the inserting shaft; and a second fastening member, screwed with the second assembly portion and contacting the inserting shaft, the second fastening member comprising a second through opening having an axis through the second through opening that is aligned with the opening of the hollow tube, an aperture of the second through opening configured to receive the inserting shaft;

wherein the first fastening member further comprises a first abutting portion that mutually fastens with the first assembly portion;

wherein the first assembly portion comprises an external thread, and the first abutting portion comprises an internal thread that screws and fastens with the external thread.

2. The bicycle trainer fastening device of claim 1, wherein the second fastening member further comprises a second abutting portion, and a first adjusting portion and a second adjusting portion disposed at two opposite ends of the second abutting portion, respectively, a length of the first adjusting portion relative to the second abutting portion is longer than a length of the second adjusting portion relative to the second abutting portion, wherein the hollow tube is selectively assembled with either the first adjusting portion or the second adjusting portion.

3. The bicycle trainer fastening device of claim 2, wherein the second assembly portion comprises a fixing section corresponding to an outer diameter of the second abutting portion and a support section located at an end of the fixing section facing the first fastening member, and the support section corresponds to outer diameters of the first adjusting portion and the second adjusting portion to accommodate the first adjusting portion and the second adjusting portion.

4. The bicycle trainer fastening device of claim 1, wherein the apertures of the first through opening and the second through opening are 5 mm.

5. The bicycle trainer fastening device of claim 1, wherein the apertures of the first through opening and the second through opening are 12 mm.

* * * * *